United States Patent [19]

Somerville et al.

[11] 4,132,387

[45] Jan. 2, 1979

[54] WINDING MECHANISM

[75] Inventors: William M. Somerville, Newcastle upon Tyne; Edward D. Watson, Gateshead upon Tyne, both of England

[73] Assignee: Clarke Chapman Limited, Tyne and Wear, England

[21] Appl. No.: 768,987

[22] Filed: Feb. 16, 1977

[51] Int. Cl.[2] ..... B66D 1/48

[52] U.S. Cl. ..... 254/173 R; 254/184; 214/14

[58] Field of Search ..... 254/172, 173 R, 186 R, 254/150 FH, 184; 214/14, 12

[56] References Cited

U.S. PATENT DOCUMENTS

| | | | |
|---|---|---|---|
| 1,999,936 | 4/1935 | Lange | 254/172 |
| 2,042,480 | 6/1936 | Patterson, Jr. | 254/172 |
| 2,402,789 | 6/1946 | Tweedale | 254/172 |
| 2,443,028 | 6/1948 | Edwards | 254/172 |
| 3,218,034 | 11/1965 | Schat | 254/172 |
| 3,309,065 | 3/1967 | Prud'homme et al. | 254/172 |

*Primary Examiner*—Trygve M. Blix
*Assistant Examiner*—Kenneth W. Noland

[57] ABSTRACT

Winding mechanism for example for cranes in which a winding drum is rotatable by two motors the first arranged to drive the drum so as to take up any slack rope when operating conditions, for example sea-state, reduce the load on the drum, the other motor driving the drum through an over-run device. If required the first motor is controllable in response to the difference between signals from the winding drum and a sensing drum in a manner to reduce the difference to zero to ensure motion of the winding drum in sympathy with motion of the messenger drum.

6 Claims, 5 Drawing Figures

WINDING MECHANISM

BACKGROUND OF THE INVENTION

The invention relates to cranes and hoists especially for marine use; and also to hauling by ropes such as in mooring or towing activities where the load on the winding drum is liable to variation which, if not compensated for, may cause unacceptable forces on equipment.

It has been proposed in U.S. Pat. No. 1,999,936 to drive a winding drum by a main motor through an epicyclic gear mechanism and by an auxiliary motor through the same mechanism. The auxiliary motor is permanently coupled to a messenger drum on which a messenger rope is wound having one end attached to an airplane required to be hoisted from the sea onto the deck of a ship by a hoist rope wound on the winding drum.

A pawl-and-ratchet is arranged when engaged to prevent rendering rotation of the messenger drum.

A manually-operable reversing switch and a rotation-sensitive on/off switch control the engagement of the pawl. The on/off switch is such that it closes and remains closed so long as the messenger drum is "heaving" i.e. winding in rope. Only change-over of the manual switch can change the condition of the pawl and is effective only when the on/off switch closes.

The pawl and ratchet is arranged such that the auxiliary motor can turn the winding drum in the "heave" sense regardless of the condition of the pawl.

However, the pawl must be engaged to provide torque reaction through the gear mechanism to enable the main motor to drive the winding drum in the "heave" sense.

The messenger rope system allows the hoist rope and hook to be lowered towards the airplane with a motion superimposed on the hook which partly corresponds to the up-and-down motion of the airplane caused by the sea-state.

In an alternative version described in U.S. Pat. No. 1,999,936, the messenger rope is dispensed with and the auxiliary motor is operable to eliminate slack from the hoist rope attached to the airplane.

Cranes hoists and analogous equipment have considerable inertia in their gear mechanisms and therefore the proposal in U.S. Pat. No. 1,999,936 has a serious drawback because the epicyclic gear mechanism in practice would have considerable inertia.

Another drawback arises from the need to use a complicated electrical system to operate the pawl even in the simple case of slack rope elimination (i.e. where no messenger rope is used).

Where the messenger rope is used in order to give compensation for sea-state motion before hoisting of the load is initiated, the epicyclic gear mechanism is incapable of allowing the hook motion to correspond exactly with sea-state motion. At least the amplitude of hook motion must of necessity be different from the amplitude of the wave induced motion of the airplane.

Therefore, attachment of the hook to the airplane is very difficult in mild sea-states and impossible in severe sea-states. Airplanes are hoisted aboard only where sea-states are reasonable.

It can be said definitely that such a system is entirely inapplicable to the attachment and hoisting of loads under difficult sea-states typically encountered in deep-water oil exploration and drilling operations where wave heights commonly exceed 4 to 6 feet but loads must nevertheless be hoisted.

BRIEF SUMMARY OF THE INVENTION

It is an object of the invention to provide winding mechanism in which the effect of inertia is reduced or eliminated in slack rope recovery.

It is a further object of our invention to provide a system which more accurately and precisely compensates for wave motion and which better enables the hook to be precisely lowered and safely secured to the load under a wider range of sea-state conditions.

The invention comprises the use of an over-run device comprising first and second parts capable of relative rotation in only one relative sense, a first reversible motor and a winding drum being connected to said first part of said device so as to take up slack, a second motor being connected to said second part of said device, said second motor also having means which is selectively operable to eliminate at least a major proportion of turning resistance imparted by said second motor on said drum.

Where wave motion compensation before attachment to the load is required, a messenger drum associated with a transmitter is used in collaboration with a transmitter on the winding drum to give a difference signal and a control means is operable to cause the first-mentioned motor to drive the winding drum so as to reduce the difference signal towards zero.

Figure 1:
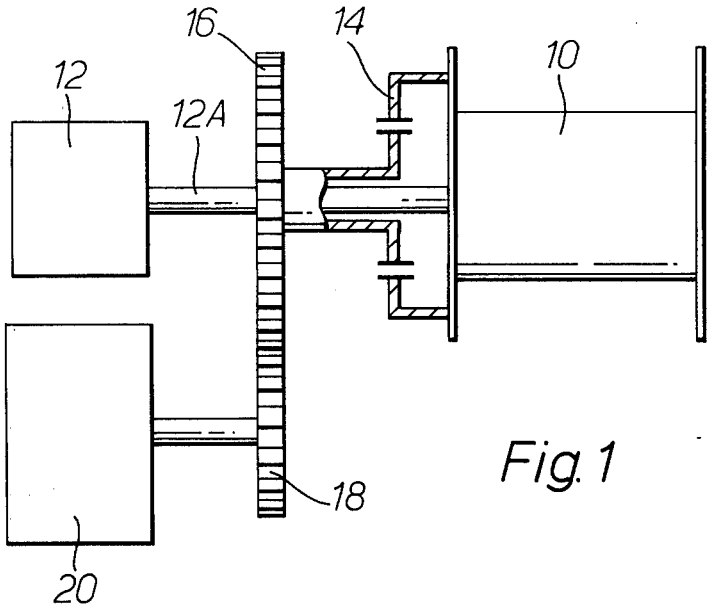
FIG. 1 is a diagrammatic layout showing the main mechanical parts of a first embodiment of mechanism.
Figure 2:
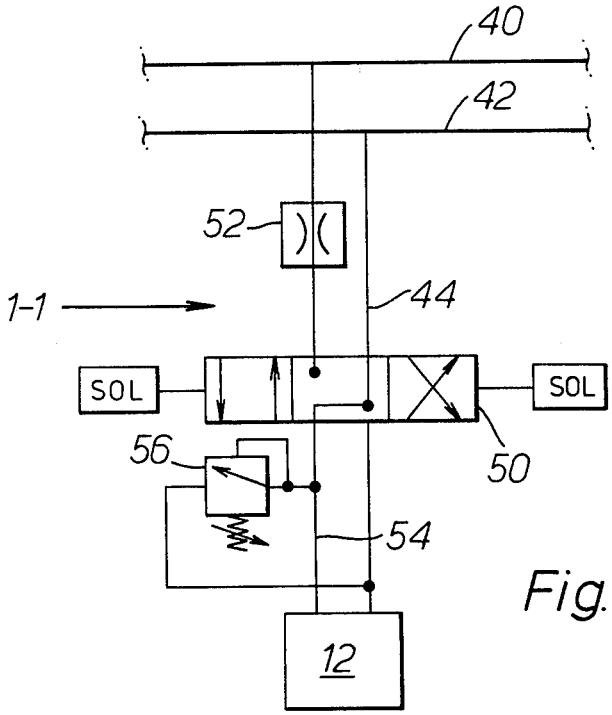
FIG. 2 is a diagram showing part of a hydraulic circuit of the first embodiment of mechanism.

The first embodiment of winding mechanism shown in FIGS. 1 and 2 of the drawings comprises a winding drum or barrel 10 which is directly connected to the output shaft 12A of a first hydraulic motor 12 which may be called a compensating motor. The motor 12 is of fixed displacement, in this case of 63 cubic inches per revolution.

The drum 10 is also connected to one part of a one-way pawl and annular ratchet mechanicm 14 the other part of which is connected to a gearwheel 16 meshing with another gear wheel 18. The gear wheel 18 is mounted on the output shaft of a second or main hydraulic motor 20.

The motor 20 is of variable displacement, in this case from 244 to 489 cubic inches per revolution.

The drum 10 is the winding drum of a crane otherwise not shown, and the crane hook is supported by a rope one end of which is connected to the drum 10.

The pawl mechanism 14 is arranged such that it is engaged when the main motor 20 rotates in the sense to drive the drum 10 in the sense to raise the load. This sense of motion of the motor 20 may be called the "heave" sense. Obviously the motor 12 rotates in the opposite sense when it is set to "heave" because it is directly coupled to the drum 10 instead of being connected to it by gears as is the motor 20.

The crane duty in this case is that it shall be capable of lifting some 14 tons at 5 meters per minute or 4 tons at 10 meters per minute. The drum in this case rotates at 2 revolutions per minute for a rope speed of 5 meters per minute.

The crane is required to handle a load under changing operating conditions, typically where the crane is mounted on a ship and is required to (a) maintain a nominal pull on the lifting rope while the hook is connected to a load which is moving either up or down with the motion of the sea;

(b) hoist the load from creep speed to full speed, the rope remaining taut at all times; and (c) lower the load from creep to full speed without compensation for slack rope.

These requirements and the desired crane duty are met by suitable selection of the motors 12 and 20; by the pulley and rope arrangements selected to apply purchase to the hook block; and by the hydraulic circuit by which the motors are driven.

FIG. 2 shows the hydraulic circuit features for the motor 12.

A high pressure hydraulic supply line is shown at 40 and a low pressure return line at 42. The lower pressure line 42 is connected to one port of the motor 12 by a line 44 via a changeover valve 50. The high pressure line 40 is connected through a restrictor 52 to the valve 50. Within the valve 50 in its neutral position the line 44 is connected to a branch line 54 connected to the second port of the motor 12. The line 54 is connected via a relief valve 56 to the line 44 intermediate the valve 50 and the motor 12.

Operation of the valve 50 in one sense or the other connects the high pressure line 40 and the low pressure line 42 to the ports of the motor 12 to energise the motor.

During certain modes of crane operation the motor 12 is driven by the drum 10 and is forced to "render" that is, to turn in the opposite sense to which it would otherwise rotate if free to do so under the applied hydraulic pressure. In those instances excess pressure built up in the high pressure side of the motor 12 is relieved through the valve 56 to the low pressure line 42. The pressure at which the valve 56 relieves pressure can be adjusted to between, in this case, 1400 and 2100 pounds per square inch. According to the setting, the pull exerted by the crane hook during hoisting compensation when the motor 12 is set to "heave" is accordingly varied between 750 pounds weight and 1150 pounds weight.

In FIG. 2 the valve is moved over in the direction of the arrow 1—1 for "heave" rotation of the motor 12 and in the opposite direction for "lowering."

OPERATION

A. Rope Remaining Taut

Load moving with sea motion

The main motor 20 has a control member movable to positions determining its hydraulic displacement per revolution. That control member is now set to the minimum position, which corresponds to a maximum speed setting, but the main motor is not energised. Instead a valve, similar to the valve 50, controlling the supply of hydraulic fluid to the motor 20 from a hydraulic power pack is set to an idling position so that the motor 20 is free to rotate under external load applied to its output shaft but is not energised from the power pack.

The compensating motor 12 is hydraulically energised by setting the control shuttle of the valve 50 in its rightward position corresponding to energisation of the motor in the "heave" sense.

Suppose now that the load moves downwardly with the sea (falling wave). The motor 20 is forced to rotate by the weight of the load but presents very little resistance to downward motion of the load. The compensating motor 12 has insufficient output torque to prevent downward motion of the load and is forced to "render". The motor 12 presents resistance to the downward motion of the load and ensures the rope remains taut. The high pressure which builds up on the high pressure side of the motor 12 is relieved to the line 42 through the valve 56.

If the load rises (rising wave) the main motor 20 is inoperative and at a standstill. However, the motor 12 responds quickly by rotating in the ∓heave" sense to turn the drum 10 to recover rope and maintain a sufficient tension on the rope. During such recovery the pawl mechanism allows movement of the drum 10 relative to the gears 16 and 18 and the motor 20.

B. Hoisting, with Compensation for Slack Rope

The rope is required to remain taut for all hoist speeds from creep speed to maximum selected speed.

The main motor 20 is energised at a "heave" setting and its displacement control is set to a position corresponding to the speed desired. The motor 12 is energised, too, in the "heave" sense.

If the load clears the sea or clears the surface of the craft on which it was supported, hoisting proceeds unabated, the main motor 20 driving the drum 10 through the pawl mechanism 14. The compensating motor 12 "follows" that is, its speed is determined by the speed of rotation of the drum 10 as dictated by the speed set for the motor 20.

If the load is suddenly lifted by the motion of the sea at a speed greater than the set hoisting speed, the compensating motor 12 maintains the rope under tension by rapidly accelerating the drum 10 as a consequence of the sudden reduction in torque load on the drum 10. During such compensation rotation of the drum 10, the latter is allowed by the pawl mechanism 14 to move relatively to the gears 16 and 18 and the motor 20.

During hoisting, the load's ascent is initially relatively slow; the sea's motion may also be upwards for a period. If, suddenly the sea's motion changes to downward motion, the load remains suspended by the rope, but the load, the rope and the crane experience very little shock because the rope was never allowed to become slack during the upward motion of the sea.

C. Lowering

The main motor 20 is energised in the "lower" sense at a displacement setting corresponding to the desired lowering speed. The compensating motor 12 is also energised in the "lower" sense and although the motor 12 tries to drive the drum 10 faster than the speed set at the main motor 20, the latter dominates the speed, because the drive from the motor 12 is in a sense to cause the pawl mechanism 14 to engage so that the main motor 20 resists the motor 12 through the pawl mechanism 14.

Figure 3:
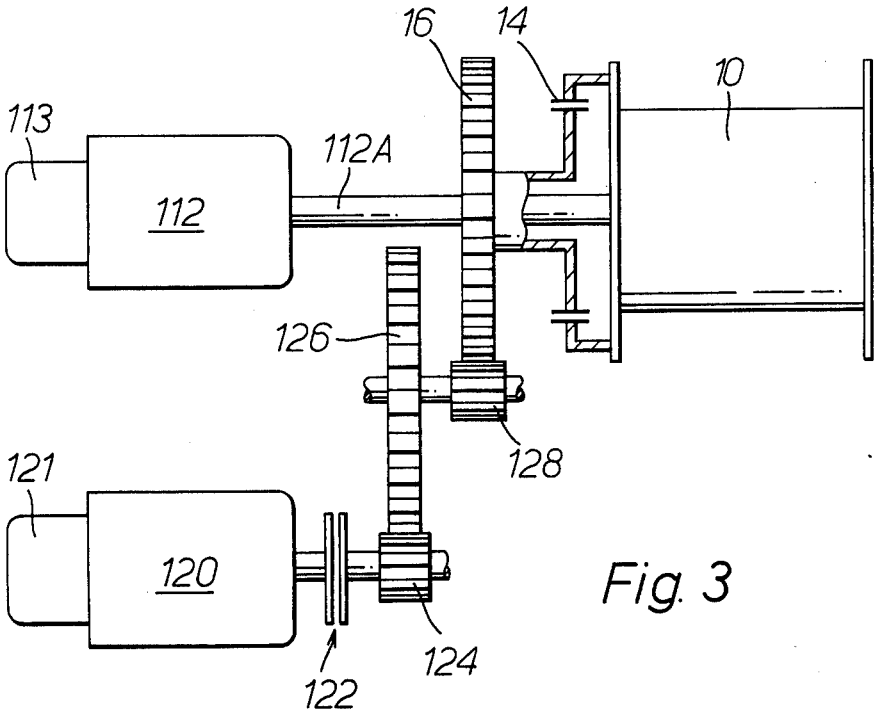
FIG. 3 is a diagrammatic layout showing the main mechanical parts of a second embodiment of mechanism.

In the second embodiment of mechanism shown in FIG. 3, the hydraulic motors 12, 20 have been replaced by electric motors 112, 120, respectively, the motor 112 having an output shaft 112A connected to the drum 10. The motors are preferably, though not necessarily, identical and are normally direct current motors with Ward Leonard or static control, to provide current limitation. The motors 112, 120 have integral fail-safe brakes 113, 121, respectively, which are spring-applied and electrically released.

The output drive from the main motor 120 comprises a clutch 122, drivingly connectable to a gear 124, which meshes with a gear 126. The gear 126 is fast with a gear 128 meshing with the gear 16. The gears 124, 126, 128 and 16 constitute a reduction gear system.

The clutch 122 is spring-engaged and electrically dis-engaged.

With the arrangement shown in FIG. 3, the direct drive from the compensating motor 112 is characterised by high speed and relatively low torque. The main motor 120 and reduction gear system give high torque at the drum at a much lower speed.

OPERATION

In the unloaded condition the winding drum is driven and controlled by the compensating motor 112, the main motor 120 being disengaged by the clutch 122 and remaining idle. When the lifting rope is attached to the moving load the compensating motor 112 is put into "heave" mode at minimum setting and when the rope is tight the setting is increased to maximum compensating heave. The load follows the wave motion partially supported by the hoist rope. The winding drum free-wheels on the pawl when the load is rising and when the load descends the compensating motor renders and the drum drives the idle gears and the disengaged clutch member.

When conditions are correct for lifting, the main hoist motor clutch is engaged just after the trough of the last wave has passed and the main hoist motor is accelerated to full speed. As the rising flank of the wave is raising the load faster than the main hoist the compensating motor winds in the rope and the winding barrel overtakes the main driving gear 'free wheeling' on the pawl. As the crest of the wave approaches the vertical motion slows down and, when the velocity falls to equal the main hoist speed, the pawl engages and the main hoist takes over, lifting the load off at the crest of the wave.

On lowering, both motors 112 and 120 are engaged in the "lower" sense and operate in the manner described with reference to FIGS. 1 and 2.

In either the hydraulic or the electric embodiment, for precision control of the unloaded hoist rope whilst heaving and lowering can be achieved as follows. The main motor always acts through the pawl. In the heaving direction the main motor drives the compensating motor in the opposite sense to which it is energised. In the lowering direction the main motor acts controllably to retard the barrel as it is driven by the compensating motor. When using the compensator motor 12 in this manner, a pressure relief means has to be provided to allow excess oil pressure to be relieved when the hoist rope is being heaved in. Alternatively, the motor 12, and the motor 112, can be set to idle during a heave operation.

The hydraulic or the electrical embodiment may be modified by change of gearing between a motor or motors and the drum. For example, the compensating motor 12 or 112 and the pawl mechanism may be located on the shaft of an intermediate gear wheel in a gear system such as the one shown in FIG. 3.

It is preferable to include in either embodiment an interlock to prevent reversion to the compensating mode of operation while a load is suspended on the crane hook.

This can be provided in the hydraulic embodiment by including a pressure-responsive switch in the pipe which is the high pressure hydraulic fluid supply pipe to the main motor 20 during "heave" operation. In the electrical embodiment the interlock can take the form of a polarised load-current sensing relay in the circuit of the main motor 120.

In either case, the interlock should have a delay feature to prevent a spurious operation during momentary changes in the indicated load when it is accelerating in the lowering direction.

The tension in the rope is a function of the resistance presented by the hydraulic or electric motors (or whichever one motor) to rotation when motion of the load drives the motor output shafts. Therefore, by choice of motor characteristic the tension can be nominal or a higher value. It follows that the invention is not limited to use in cranes. The invention may be applied to lifting and lowering situations generally wherever conditions change during operation and it is required to maintain the rope under tension. For example, winches mounted in helicopters are commonly used for lifting and lowering loads under changing conditions, such as where the load has to be raised from or lowered to the surface of the sea or the deck of a boat, vessel, drilling platform or rig; or other structure on or adjacent the sea's surface. In such circumstances the motion of the sea's surface or the effect of air movement or both impose rapidly changing operating conditions on the winch. The invention can maintain rope tension under such conditions, the drum 10 then being a winch drum.

Another example of the use of the invention is where the drum is a drum of a winch which is required to act as a self-tensioning or automatic ship's mooring winch. Self-tensioning winches are used for mooring ships and are used as towing winches in tugs and as towing winches for trawling nets in fishing operations.

In all such applications, and in other analogous operations the invention can maintain tension in a rope wound by the drum (corresponding to the drum 10) of the winch. The invention also enables automatic rendering of rope under increased load conditions; for example as where a moored ship is subjected to an additional force caused by wave or tidal movement or by an increase in wind force.

The winch also automatically recovers rope when the force reduces to the former value.

Figure 4:
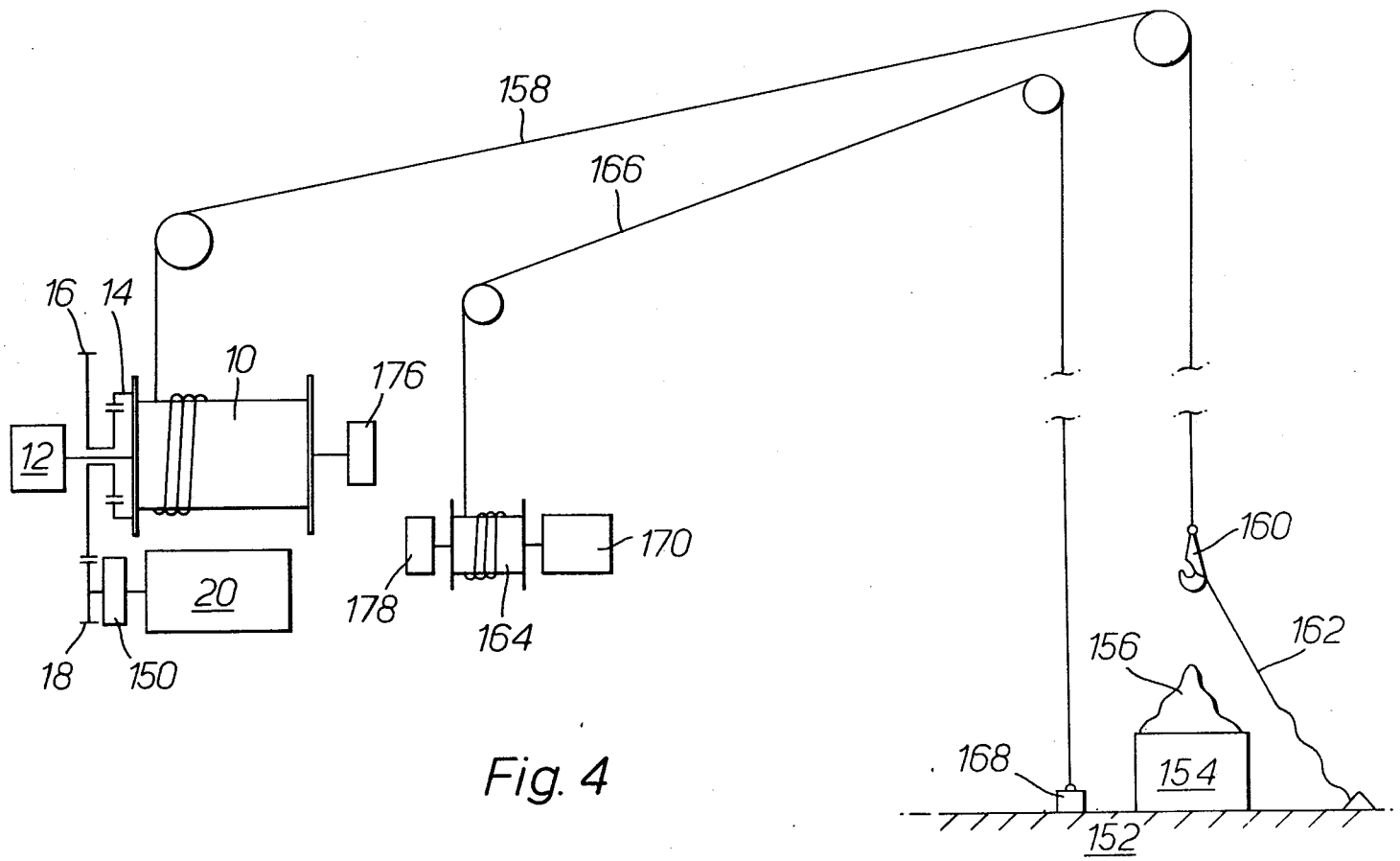
FIG. 4 is a diagrammatic layout showing the main mechanical parts of a third embodiment of mechanism.

The invention can be applied to a crane which is required to be able to (i) lower its hook slowly towards a ship's deck while at the same time motion is imposed on the hook which copies the motion of the ship's deck resulting from the sea's wave and swell action; and (ii) maintain its hook at a constant or approximately constant distance from a ship's deck before a load is attached to the hook: for example where the crane is mounted on a first vessel or structure and the load is to be lowered from that vessel to, or raised to that vessel from, the deck of a second vessel e.g. a supply ship. The first vessel or structure may be a drill ship, for example, or a drill rig or platform; or some other vessel or structure. FIG. 4 shows an example of mechanism suitable for such a crane and FIG. 5 shows, in block diagram form, the control system of the mechanism.

It is common for offshore cranes such as used on vessels or structures of the kind just mentioned to have a main hoist capability of say 25 tons capacity and an auxiliary or so-called "whip-hoist" capability of say 20% to 40% of the main hoist capability i.e. 5–10 tons. The whip hoist has typically but a single fall of wire to its hook and can operate at relatively high speed.

The compensation system described above can readily be applied to both the main and the whip hoist and there is no need to duplicate the system.

Figure 5:
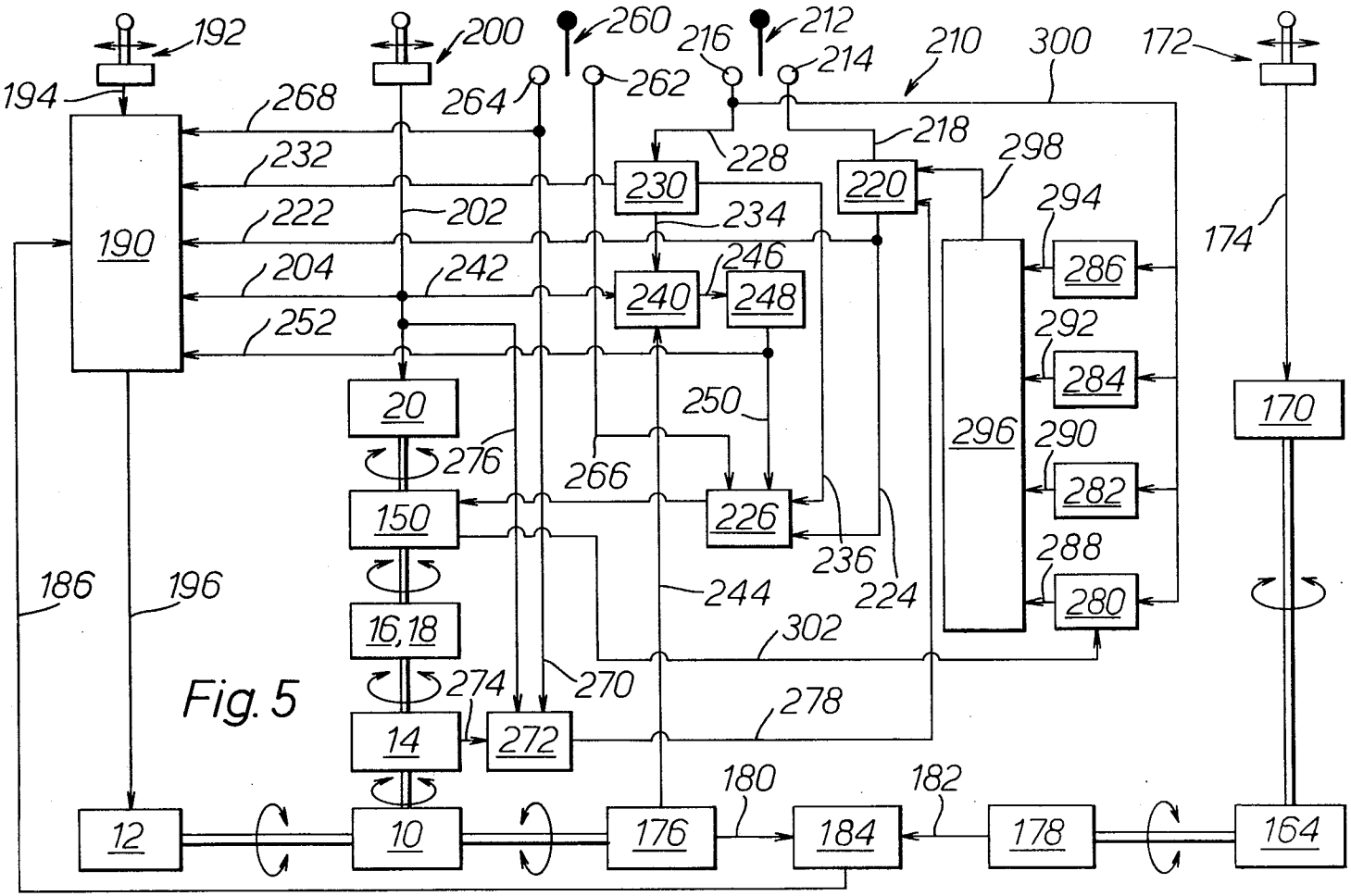
FIG. 5 is a block diagram showing the parts of the mechanism shown in FIG. 4 together with the control system for the mechanism.

FIGS. 4 and 5 show parts similar to those shown in FIG. 1 and corresponding reference numbers are used for those parts.

The clutch 14 is a free-wheel clutch. The motor 20 drives the gear 18 through a slipping clutch 150, that is a clutch which transmits drive up to a predetermined value of torque but which slips when that torque is reached.

A ship's deck is indicated at 152 on which there is a load 154 waiting to be raised to the platform or other structure on which the crane is mounted. The load has sling means 156. The crane comprises a hoist wire rope 158 running from the barrel 10 and having a load hook 160. A tag-line 162 is shown connecting the hook 160 to the deck 152.

The crane also comprises a messenger hoist barrel 164 from which a messenger wire 166 runs to a switchable permanent magnet or, alternatively, a light hook 168 attachable to the deck 152.

The messenger barrel 164 is driven by a messenger motor 170 which has a manual controller 172 from which a signal can pass along line 174 to the motor 170 (see FIG. 5).

The barrels 10 and 164 have respective transmitter means 176, 178 which give signals representing the instantaneous position and sense of rotation of the respective barrels. The signals pass along lines 180, 182, respectively (see FIG. 5) to an error determination unit 184. A signal passes along line 186 from the unit 184 to a compensating motor control unit 190.

The compensating motor 12 has a manual controller 192 from which a signal can pass along line 194 to the control unit 190. The control unit 190 produces a control signal for the motor 12 in line 196.

The hoist motor 20 has a manual controller 200 from which a signal can pass to the motor 20 along line 202. A signal can also pass along line 204 from line 202 to the control unit 190.

A "select lift"/ "select compensation" control system is generally indicated at 210. The system 210 has a manual switch 212 having an off position, a select compensation position 214 and a select lift position 216; the switch 212 having a make-before-break action between the positions 214 and 216.

The "select compensation" position 214 of the switch 212 completes a circuit to give a signal in line 218 to a "select compensation" control unit 220. The unit 220 produces an output signal in line 222 to the compensating motor control unit 190 and in line 224 to a clutch control unit 226.

The "select lift" position 216 of the switch 212 completes a circuit to give a signal in line 228 to a "select lift" control unit 230. The unit 230 produces output signals in line 232 to the compensating motor control unit 190; in line 234 to a guard relay unit 240; and in line 236 to the clutch control unit 226.

The guard relay unit 240 also receives signals along line 242 from line 202, i.e. from the hoist motor controller 200, and along line 244 from the transmitter 176 associated with barrel 10.

The guard relay unit can produce a signal in line 246 to a timer 248 which in turn can produce a signal in line 250 to the clutch control unit 226 and in line 252 to the compensating motor control unit 190.

To enable the system to be put into compensation automatically, a manual switch 260 having an off position, a hold position 262 and an automatic release position 264.

In the hold position 262, the switch 260 provides a signal along line 266 to the clutch control unit 226.

In the automatic release position 264, the switch 260 provides a signal along line 268 to the compensating motor control unit 190, to cause it to operate the motor such that it maintains a heaving torque, and along line 270 to a control unit 272. The control unit 272 also receives a signal along line 274 from a switch (not shown) which detects relative movements of the two parts of the free-wheel clutch 14 and a signal along line 276 from line 202 of the hoist motor controller 200. The control unit 272 provides an output signal along line 278 to the "select compensation" control unit 220.

Four overload protection devices 280, 282, 284 and 286 are provided. Each device can feed a signal along respective lines 288, 290, 292 and 294 to a signal transmitter 296. The transmitter 296 on receiving a signal from one or more of the devices 280, 282, 284 and 286 transmits a signal along line 298 to the "select compensation" control unit 220 to cause reversion of the system to auto-compensation. The devices 280, 282, 284 and 286 are only active when the switch 212 is in position 216, which provides a signal in line 300 activating the devices.

The device 280 is a clutch overload device which receives a signal from an overload detection switch (not shown) in the clutch 150 along line 302. The devices 282, 284 and 286 are, respectively, a load indicator device; a load moment indicator device; and a hoist motor overload device.

OPERATION

The system shown in FIGS. 4 and 5 can best be understood by considering its operation assuming a load is to be lifted from a supply ship's deck. The description is applicable to operation of a main hoist of the crane of say 25 tons capacity or to a so-called "whip-hoist" of say 10 tons capacity. The crane described would have both hoists and the automatic control facility can be applied to the compensating system of either hoist. In the description that follows, the term "hook hoist" is applicable to either a main hoist or a whip hoist.

The motion-compensation system is locked out when the hook 160 is more than a pre-selected distance above the ship's deck 152. Normal operation is permitted for working to the level of the deck of the platform carrying the crane. As the hook is lowered towards the supply ship it becomes possible to engage the automatic system. This is achieved having an indicator, e.g. a rope length "out" indicator, (not shown) which feeds a signal into the unit 190 to lock out the unit 190 or to make it available for compensation. In the locked out condition, the unit 190 causes the motor 12 to "follow" the motor 20 owing to the signal in line 204. In the available condition, other signals to the unit 190 over-ride the signal in line 204.

LOWERING UNLOADED HOOK

The hook is lowered under normal control to a level at a safe distance above the heaving deck 152 of the supply ship and stopped. The messenger wire 166 is then lowered using the manual controller 172 and secured to the supply ship's deck abeam the load. When secure, the controller 172 is set to "constant tension" to tauten the wire. A signal is now available in line 182 from the transmitter 178 to the error determination unit 184 indicating the rise and fall of the ship's deck. The compensating motor controller 192 is in "neutral" and the system not yet activated. The operator waits until the ship is near the top of a wave and moves switch 212 to the "select compensation" position 214.

This action produces a signal in line 218 to activate the "select compensation" control unit 220. The activated unit 220 simultaneously produces signals in lines 222 and 224. The signal in line 224 causes the clutch control unit 226 to disengage clutch 150. The signal in line 222 activates the compensating motor control unit 190. The unit 190 produces an output signal in line 196 to cause the motor 12 to respond in such a manner that the error signal the unit 190 is receiving along line 186 from the error determination unit 184 is reduced to zero. This causes the hook 160 to follow the messenger wire 166 up and down with the wave motion and maintains the hook 160 at a substantially constant distance above the ship's deck 152.

The compensating motor controller 192 is now moved by the operator to "lower." This introduces a positive error signal along line 194 into the unit 190 so that in attempting to reduce the error to zero, the unit 190 controls the compensating motor 12 to impart a slight differential to the compensated motion of the hook 160, which brings the hook 160 closer to the ship's deck. The differential motion of the hook 160 with respect to the messenger wire 166 may be halted or reversed by the operator's using the compensating motor controller 192 to select the "neutral" or "heave," respectively.

HOOKING-ON

Where lateral movement of the hook 160 and its ponder-ball (not shown) is excessive, a tag-line 162 from the ponder-ball may be secured to the ship's deck and the compensating motor controller 192 set to "heave." This action tautens the wire without interrupting the compensation action. The slings 156 may now be engaged in the hook in relative safety. When the slings are in place, the compensating motor controller 192 is set to "lower" to aid the release of the tag-line and then set to "heave" to tighten the slings.

LIFTING OFF

Lifting clear is semi-automatic. The operator on receiving the signal to lift moves switch 212 to the position 216 and pulls the hook hoist controller 200 to "heave" when the vessel is in the trough of a wave.

The switch 212 in position 216 produces a signal in line 228 to activate the select lift control unit 230.

Because the switch 212 is a make-before-break switch, the unit 230 is activated before the "select compensation" control unit 220 is de-activated. This enables the select lift control unit 230 to produce signals in lines 232 and 236 to the compensating motor control unit 190 and the clutch control unit 226 to cause the unit 190 to maintain the system in the compensating mode and to cause the unit 226 to maintain the clutch 150 disengaged. Thus, when the "select compensation" unit 220 de-activates, the "select lift" control unit 230 takes over the function of the unit 220 for a time.

The "select lift" control unit 230 as well as functioning as above, also provides a signal in line 234 which arms the guard relay 240 and provides a signal in line 300 to activate the overload protection devices 280, 282, 284 and 286.

The guard relay 240 receives a signal along line 242 which "proves" the hook hoist controller 200 is activated in "heave" sense and receives a signal along line 244 from the transmitter 176 attached to the barrel 10. When conditions are correct, i.e. the vessel starts to rise on a wave, the guard relay 240 energises and produces a signal in line 246 to start the timer 248 which after a short delay produces a signal in line 250 to cause the clutch control unit 226 to engage the clutch 150 overriding the signal in line 236 from the unit 230.

The clutch 150 and gear-train assembly 16, 18 has the free-wheel clutch 14 which allows the compensation motor 12 and the hook hoist barrel 10 to overtake the hook hoist motor 20. As the vessel nears the crest of the wave, the speed of the load falls until it matches that of the slower hook hoist motor 20. The hook hoist motor drive is applied through the free-wheel to the barrel 10 so that the load 154 is lifted clear on the crest of the wave. The compensating motor 12 is locked into full "heave" by a signal from the timer 248 along line 252 to the compensating motor control unit 190, this signal activating the unit 190 to over-ride the signal in line 232 from the unit 230.

If the load 154 is for some reason still attached to the vessel or is too heavy or the crane is at too great a working radius this will be detected by at least one of the overload protection devices 280, 282, 284 and 286.

The detection of an overload will cause a signal from one of the devices to appear in the transmitter 296 and then in the "select compensation" control unit 220. The unit 220 will cause reversion to auto-compensation by declutching the main drive whilst retaining the compensation motor 12 at full "heave" torque. This minimises jib reaction and the compensating motor 12 renders as the vessel falls away.

If the lift is successful, the messenger wire 166 must be cast loose as soon as the load 154 is well clear of the ship. The messenger wire 166 is wound in automatically to its standby position.

LOWERING A LOAD TO THE SHIP'S DECK

The power flow required to move a maximum load up and down in sympathy with the ship's deck is very large and the periodic supply and recovery of this energy would cause technical problems in the design of the prime mover or the power supply system. Such difficulties are avoided by the use of the following mode of operation.

The load to be transferred from the platform to the ship is lifted normally by the hook hoist drive and swung out over the ship. The messenger wire 166 is lowered to the ship's deck and secured, whilst the load is lowered normally to a point a short distance above the highest point of the ship's motion. When the load is correctly positioned, the operator selects creep lower (10–15 ft/min) on the hook hoist controller 200 and selects the automatic release position 264 on switch 260, and 276. This action prepares the system for automatic compensation signals being passed along line 270 to the control unit 272 to activate it; and a signal being passed along line 268 to cause the motor 12 to maintain a heaving torque. As the load is progressively lowered, a point is reached when it is lifted by the ship's deck at the crest of a wave. The compensating motor 12 then heaves in the slack wire and the relative motion of the parts of the free-wheel are detected by the switch (not shown) which passes a signal to the control unit 272.

The control unit 272 produces a signal in line 278 to the select compensation control unit 220 which provides a signal along line 222 to cause the compensating motor control unit 190 to activate in the compensating mode to respond to the error signal from the error determining unit 184; and provides a signal in line 224 to the clutch control unit 226 to disengage the clutch 150, as previously described. The signal along line 222 overrides the signal along line 268 from the switch 260.

For safety, this automatic release is interlocked so that automatic release can only take place when the hoist control is in the lowering sector, automatic release is selected and a "lift" by the ship's deck is detected.

Once the system is committed to automatic compensation by the above conditions, it is not possible to switch back to hold. The load can then only be lifted by the lift-off sequence. This precaution is necessary to prevent severe impact loads on the crane and between the load and the deck, which would occur if the load was suspended deep within the ship's zone of motion.

The subsequent motions of the parts of the free-wheel device 14 do not affect the control unit 272 as it arranged to produce continuous signals in line 278. However, it is preferred for safety that the operator also moves switch 212 to the select compensation position 214 as soon as possible after compensation commences.

If the operator sees that the load is going to be incorrectly positioned (e.g. it will end up on a ships side rails), the operator can prevent automatic release by moving the switch 260 to the hold position 262 which gives a signal along line 266 to the clutch control unit 226 to ensure the clutch 150 is locked in the engaged position. Alternatively, he can simply pull back the hoist controller 200 to neutral or heave which removes the signal in line 276 and so prevent automatic release of the system into the compensation mode.

LOWERING-ON LIMITATION

It will be evident that for light loads where the load is less than the hoisting capability of the compensating motor that the light hook procedure will be used for lowering such loads.

For loads greater than this but less than the self-rendering load of the compensating motor (i.e. between 3 and 20% rated load) the lowering-on system becomes indeterminate and it is necessary to set the compensating motor in a drive-down condition. The messenger wire 66 must be used and the height and timing of the energisation of the compensation system must be judged by the operator with the aid of signals from the ship and the load indicator mounted in the crane's cabin.

In this case, when compensation is active, the compensating motor control should be returned to "neutral" to prevent excessive slack developing in the hoist wire and to keep the ponder-ball clear of the deck.

POWER LOSS

Should the crane lose hoist power when in an active compensating mode, both the hoist motion brake and clutch are engaged automatically by springs thereby preventing the load from falling.

If the crane hook is in any way attached to the ship, a load limiting slipping clutch will operate at 150% rated load to prevent breakage of the hoist rope.

In the above description the term "rope" is to be taken to include rope, as such, whether of wire or other material, and also cable, chain cable and cable as such.

A fixed displacement motor can be used, if preferred, in place of the variable displacement motor 20. Speed control then would be provided entirely by control of the hydraulic pump feeding the motor.

The control systems described with reference to FIG. 5 is equally applicable to electric motors used in the crane described in FIG. 4.

What we claim is:

1. Winding mechanism comprising a winding drum for raising and lowering a relatively moving load, first and second reversible motors for driving said drum, first and second control means selectively operable to determine the sense of driving rotation of said first and second reversible motors, respectively, an over-run device comprising first and second parts capable of relative rotation in only one relative sense, said drum and said first motor being connected in driving relationship to said first part of said device, said second motor being connected in driving relationship to said second part of said device, said drum receiving drive from said first motor at first speeds higher than second speeds at which said drum receives drive from said second motor, said second motor having associated means which is operable selectively by said second control means to eliminate at least a major proportion of turning resistance imposed by said second motor on said drum during idle motion of said drum, and said first motor being operable to maintain said over-run device in condition to connect said drum rotationally to said second motor during lowering of said load whereby said second motor dominates the lowering speed of said load.

2. Winding mechanism according to claim 1, in which both said motors are hydraulic motors and in which said first motor has relief means operable to permit hydraulic fluid to be relieved from the motor when it is driven by said winding drum and in which said second control means comprises hydraulic control valve means and in which said associated means comprises a portion of said control valve means operable in an idle position of said control valve means to permit hydraulic fluid to be relieved from said second motor during idle motion of said winding drum.

3. Winding mechanism according to claim 1, in which both said motors are electric motors, and in which said associated means comprises clutch means selectively operable to disengage said second motor from said winding drum.

4. Winding mechanism according to claim 1, in which said over-run device is a pawl mechanism.

5. Winding mechanism according to claim 1, in which a drive shaft directly drivably connects said first motor to said drum, said first part of said device being mounted on the drum, and gearing drivably connects said second motor to said second part of said device.

6. Winding mechanism comprising a winding drum, first and second reversible motors for driving said drum, first and second control means selectively operable to determine the sense of driving rotation of said first and second reversible motors, respectively, an over-run device comprising first and second parts capable of relative rotation in only one relative sense, said drum and said first motor being connected in driving relationship to said first part of the device, said second motor being connected in driving relationship to said second part of said device, said drum receiving drive from said first motor at first higher speeds than second speeds at which said drum receives drive from said second motor, said second motor having associated means which is selectively operable by said second control means to eliminate at least a major proportion of turning resistance imposed by said second motor on said drum during idle motion of said drum, a messenger winding drum, a reversible messenger motor for driving said messenger drum, first and second transmitter means arranged in relationship to said winding and messenger drums, respectively, to originate respective signals representing the respective instantaneous angular positions and respective senses of rotation of said winding and messenger drums, respectively, and motor control means connected in signal receiving relationship with said transmitter means and in control signal transmitting relationship with said first motor and said messenger motor and operable to control said first motor so as to reduce towards zero the difference between signals from said transmitter means thus to cause compensating motion of said winding drum, said motor control means comprising a manually-operable master controller by which an error may be variably introduced into said control signal to superimpose an approach motion upon said compensating motion of said winding drum.

* * * * *